United States Patent [19]

Notelteirs et al.

[11] 4,180,758

[45] Dec. 25, 1979

[54] CAPLESS ELECTRIC INCANDESCENT LAMP

[75] Inventors: Victor R. Notelteirs; Josephus F. Rijckaert, both of Eindhoven, Netherlands

[73] Assignee: U.S. Philips Corporation, New York, N.Y.

[21] Appl. No.: 834,953

[22] Filed: Sep. 20, 1977

[30] Foreign Application Priority Data

Oct. 1, 1976 [NL] Netherlands ..... 7610860

[51] Int. Cl.[2] ..... H01J 5/48

[52] U.S. Cl. ..... 313/318; 339/75 M

[58] Field of Search ..... 313/318

[56] References Cited

U.S. PATENT DOCUMENTS

| | | | |
|---|---|---|---|
| 2,937,308 | 5/1960 | Howles et al. | 313/315 |
| 3,345,526 | 10/1967 | Wright | 313/318 X |
| 3,999,095 | 12/1976 | Pearce et al. | 313/318 |

*Primary Examiner*—Alfred E. Smith
*Assistant Examiner*—Charles F. Roberts
*Attorney, Agent, or Firm*—Robert S. Smith

[57] ABSTRACT

A capless electric incandescent lamp comprises a lamp envelope having a flat pinch. A first wide side face of this flat pinch has current supply wires bent backwards along the extent thereof. A second wide side face of this pinch has means to suitably cooperate with a fixing member in a lampholder.

5 Claims, 6 Drawing Figures

CAPLESS ELECTRIC INCANDESCENT LAMP

The invention relates to a capless electric incandescent lamp having a light-pervious lamp envelope, in which a filament is arranged and which is sealed by means of a flat pinch in which current supply conductors to the filament are incorporated which emanate from the lamp envelope at the end face of the pinch and are bent backwards along the surface of the pinch in the direction of the filament, the surface of the pinch having means to cooperate with a fixing member in a lampholder.

Such lamps are disclosed in U.S. Pat. No. 2,937,308. The lamps are used in particular for vehicle illumination.

In the known lamps the current supply wires are bent backwards one on either side of the pinch in the direction of the filament so that a respective current supply wire is situated along each major face of the pinch. The advantage of this is that the wires cannot contact each other and thus cause a short-circuit. An important drawback, however, is that a lamp can be placed in either of two positions in a lampholder, and that a lamp in a lampholder assumes an axially rotated position. The result of this is that the position of the filament of the lamp with respect to the lampholder is poorly defined, whereas high requirements are imposed on the position of the filament when a lamp is used in a reflector.

It is the object of the invention to provide lamps which can be operated only when placed in a holder in a particular way and in which furthermore when a lamp is repeatedly placed in a holder, only a very small variation in the position of the filament occurs.

Another object of the invention is to provide lamps in which a good electrical contact is ensured when the lamp is placed in a lampholder and in which the electrical contact and the position of the lamp are little sensitive to vibrations.

According to the invention, these objects are acheived in lamps of the kind mentioned in the preamble in that the current supply conductors are bent backwards along a first major face of the pinch which is provided with means for preventing mutual contact between the backwards-bent current supply conductors, the second, opposing major face of the pinch having position fixing means to cooperate with a fixing member in a lampholder.

Mutual contact of the backwards-bent current supply conductors can be prevented, for example, by a number of cams provided between the conductors on the surface of the pinch. It is alternatively possible upon making the pinch to provide a rib extending in the axial direction of the lamp on the pinch surface on either side of which rib a current supply conductor is situated. Such a boss may also serve as a guide when placing a lamp in a lampholder.

However, to be preferred are grooves in the surface of the pinch, extending in the axial direction of the lamp, in which grooves the current supply conductors are situated. These grooves preferably have a depth which is less than the thickness of the conductors so that the latter project above the main surface of the pinch. The advantage of such grooves is that the conductors cannot move apart either.

The advantage of the lamps according to the invention is that the two backwards-bent conductors together constitute a readily defined reference surface with which the lamp in a lampholder can be pressed against a surface having electrical contacts. In contrast with the known lamp, in which the current supply wires are bent backwards on opposite sides of the pinch, a pressure force need be exerted on the lamps according to the invention, when in a lampholder, only in one direction at right angles to the second major face of the pinch in order both to produce a good electrical contact withe the contacts of the lampholder for both current supply conductors, and to keep the reference face of the lamp in the correct place in the lampholder.

The position fixing means on the second major face suitable to cooperate with a fixing member in the lampholder face may consist of a rib on the surface of said face or a groove therein. The rib or the groove preferably extends transverse to the axial direction of the lamp. In another embodiment the second major face has two or more grooves or ribs extending in the longitudinal direction of each other while it is also possible that two or more parallel extending grooves or ribs are present. Alternatively, the side face may have both a groove and a rib. Said means may also be used to prevent lamp types or lamps of power values for which a given holder is not suitable from being placed in the lampholder. The position fixing means also serve accurately to determine the position of the lamp longitudinally in the holder, with the result that the positional relationship between the filament and the holder is fixed very precisely. The distance between the filament and the positional fixing means, measured in the axial direction of the lamp is referred to as the light center length of the lamp.

In order to facilitate the placing of the lamps in a lampholder and also to simplify the bending backwards of the current supply conductors along the first major face of the pinch, in a special embodiment of the lamp the edge of the first major face adjoining the pinch end face from which the current conductors emerge is bevelled.

In a preferred embodiment, the edges of the second major face which extend parallel to the longitudinal axis of the lamp are bevelled. Said bevels preferably extend at an angle ($\alpha$) of $30° \pm 10°$ with the narrow side faces of the pinch. In a further preferred embodiment said bevels extend halfway between the two opposing major faces.

Such bevelled edges have the advantage that the tolerances on the pinch width are widened, while the lamps can nevertheless be aligned by means of centering members in the lampholder which engage said bevelled edges in the direction transverse to the lamp axis and parllel to the above-mentioned reference face.

In another embodiment, which is attractive because less displacement of glass is necessary upon pinching, the lamps also have corresponding bevelled edges on the first major face, although said bevelled edges preferably do not extend as far as halfway between the two opposing major faces.

The lamps according to the invention are particularly suitable for use as vehicle lights, such as motorcars, bicycles, mopeds, for projection purposes, and the like.

The invention allows in particular the construction of miniature lamps having very narrow tolerances for the filament position both with respect to the light center length and with respect to the reference face, which lamps, when being placed in a holder, show only a very small variation in the position of the filament with respect to the holder. Miniaturized lamps have the advantage of a mechanically stronger lamp envelope, so that high gas pressures can be used, which has favourable effects on the life and luminous efficiency.

The lamps preferably have a halogen-containing gas filling, for example a bromine and hydrogen-containing gas filling, and a hard glass cylindrical lamp envelope. The lamp envelopes usually consist of alkalialuminoborosilicate glass having a coefficient of thermal expansion of $31-37\times10^{-7}$°C.$^{-1}$ at 0°-300° C. Such glasses consist mainly of 77-81% by weight of $SiO_2$, 12-15% by weight of $B_2O_3$, 3-5.5% by weight of $Na_2O$ and 1.5-2.5% by weight of $Al_2O_3$. As current supply conductors molybdenum wires are frequently used which, so where they are situated in the pinch, are precoated with a coating of the same type of glass. The parts of the current supply conductors situated outside the lamp envelope are preferably provided with a corrosion-resistant envelope, for example a nickel sleeve which is connected to the wire by flattening it onto the wire.

The invention also relates to a lampholder for the lamps according to the invention. The lampholder comprises electrical contacts which are insulated electrically from each other and a fixing member for positionally fixing a lamp in the holder and is characterized in that it comprises two opposing walls a first of which is provided with the contacts and the second of which includes the fixing member, the latter having a spring action directed towards the first wall.

In a preferred embodiment the lampholder comprises on either side of the fixing member means to center the lamp, which means are arranged resiliently in a more preferred embodiment. An embodiment of a lamp according to the invention is shown in the figures.

Figure 1:
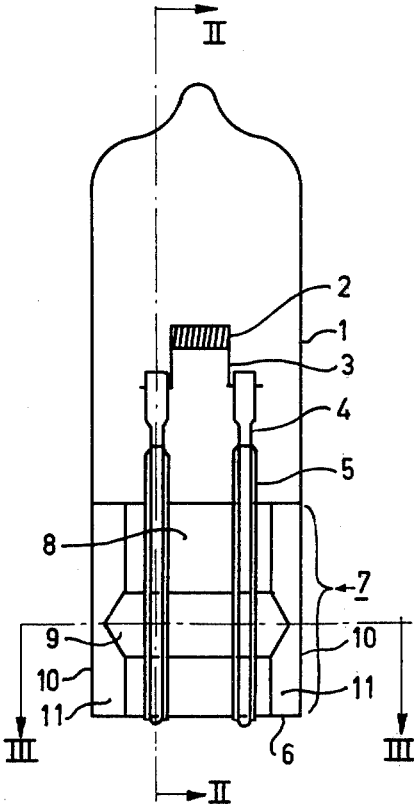
FIG. 1 is an elevation of a lamp.

Reference numeral 1 in FIG. 1 denotes a glass lamp envelope in which a filament 2 is arranged the limbs 3 of which are clamped between the bent-over ends of the current supply conductors 4. A glass coating 5 is provided around said conductors so as to extend beyond the end face 6 of the pinch 7. A V-shaped groove 9 which extends transversely to the axial direction of the lamp is provided in the (second) major face 8 of the pinch. The edges of the second major face 8 adjacent the narrow side faces 10 have bevelled edges 11.

References numerals 1 to 11 in the other figures correspond to those of FIG. 1.

Figure 2:
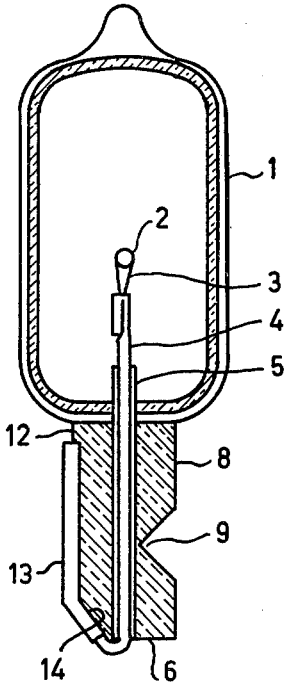
FIG. 2 is a longitudinal sectional view taken on the line II—II.

Reference numeral 12 in FIG. 2 denotes the first major face of the pinch along which both the current supply conductors 4 are bent backwards towards the filament. In this figure, the current supply conductors outside the lamp envelope are provided with corrosion-resistant envelopes 13. The pinch has a bevelled edge 14 at the transition of the end face 6 and the first major face 12.

Figure 3:
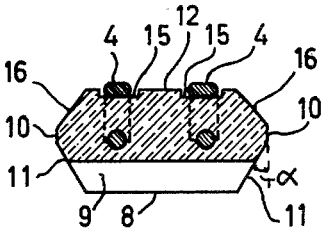
FIG. 3 is a cross-sectional view taken on the line III—III.

In FIG. 3 grooves 15 extending in the axial direction of the lamp are visible in the first major face 12 of the pinch in which grooves the current supply conductors 4 are situated. In these figures, bevelled edges 16 exist on the transitions of the narrow side faces 10 of the pinch and the first major face 12. The bevelled edges 11 enclose an angle $\alpha$ with the narrow side faces 10.

Figure 4:
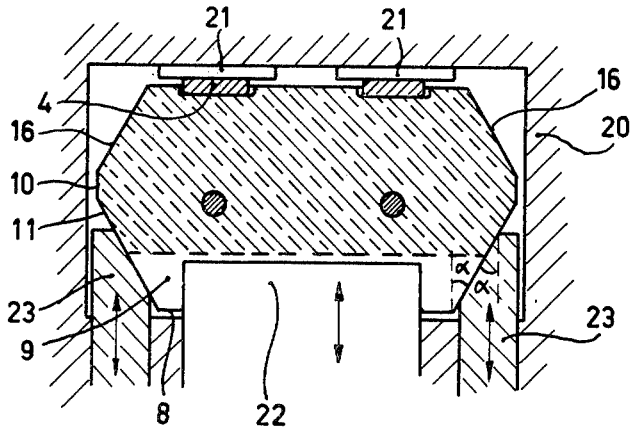
FIG. 4 is a further large-scale representation of FIG. 3 in which the lamp is placed in a holder which is shown diagrammatically.

FIG. 4 shows the pinch of a lamp in a sheathing holder 20 in which two contacts 21 are provided so as to be electrically insulated from each other. The lamp is fixed in the holder by a fixing member 22 which engages in the V-shaped groove 9 in the second major face of the pinch. The fixing member 22 exerts a force at right angles to the surface of the major face 8 so that the backwards-bent current supply conductors 4 are each pressed against a contact 21.

The width of the holder 20 in the figure is larger than the distance between the narrow side faces 10 of the pinch so as to allow a larger tolerance on the pinch width. The lamp is centered in the holder by resilient pins 23 having end faces which are bevelled at the same angle $\alpha$.

EXAMPLE

In a practical case a lamp according to the invention had the shape of the FIGS. 1 to 3, but had dimensions which were only 1/5 thereof. The lamp had molybdenum current supply conductors which were precoated with coatings of hard glass, consisting of 80.5% by weight of $SiO_2$, 13% by weight of $B_2O_3$, 3.5% by weight of $Na_2O$, 0.7% by weight of $K_2O$ and 2.3% by weight of $Al_2O_3$. The lamp envelope consisted of the same type of glass. Outside the lamp envelope the conductors were each enveloped by a nickel sleeve which was flattened on the conductors. The lamp envelope was filled with 7 atm. krypton to which 0.1% by vol. of $CH_2Br_2$ had been added. The lamp consumed a power of 12 W with an applied voltage of 6.75 V.

Figure 5:
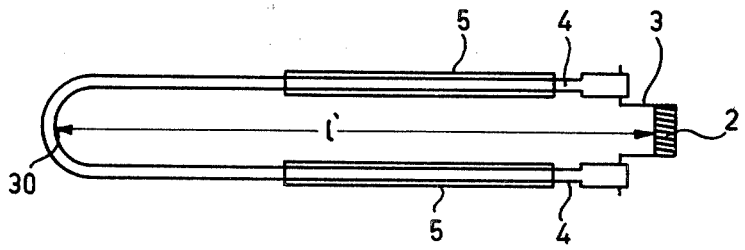
FIG. 5 shows an intermediate product in the manufacture of a lamp.

In manufacturing the lamp the two current supply conductors 4 together constituted one U-shaped bent wire on which the glass coatings 5 had already been provided. The limbs 3 of filament 2 were clamped in such a position by bending the ends of the U-shaped bent wire that the filament was at a distance 1' from the bend 30 in said wire (see FIG. 5).

Figure 6:
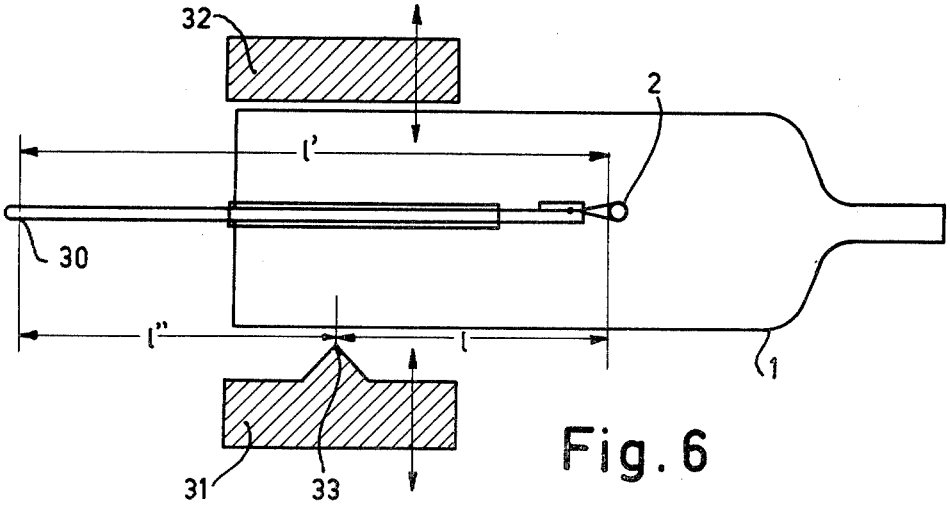
FIG. 6 shows diagrammatically a step in the manufacture of a lamp in which the intermediate product of FIG. 5 is viewed from the side.

A glass tube 1 (FIG. 6) was then provided over the assembly of the current supply conductors and filament, after which the pinch was formed by means of the pinching blocks 31 and 32 shown diagrammatically in the figure. The rib 33 on pinching block 31, which rib forms the V-shaped groove 9 in the pinch, was at a distance 1'' from the bend 30. In this manner lamps having a light center length 1 were obtained.

What is claimed is:

1. A capless electric incandescent lamp having: a light-pervious lamp envelope sealed by means of a flat pinch having first and second opposed major faces, a filament disposed in said envelope, two current supply conductors connected to said filament extending through said flat pinch and emanating from said lamp envelope at the end of said pinch remote from said envelope, said conductors being bent backwards along the surface of said first major face of said pinch in the direction of said filament, said first major face being provided with means for preventing contact between the portions of said current supply conductors extending along said first major face, said second major face of said pinch having position fixing means for cooperating with a fixing member in a lampholder, said position fixing means comprising a V-shaped groove extending across said second major face.

2. A capless electric incandescent lamp as claimed in claim 1 wherein said means for preventing contact comprises two discrete grooves in said first major face of said pinch extending in an axial direction of said lamp.

3. A capless electric incandescent lamp as claimed in claim 2 wherein said current supply conductors project above the main surface of said first major face of said pinch.

4. A capless electric incandescent lamp as claimed in claim 1 wherein said pinch includes an end face which is disposed substantially at right angles to said first and second major faces and said end face includes bevelled edges.

5. A capless electric incandescent lamp as claimed in claim 1 wherein said second major face includes bevelled edges.

* * * * *